US011691435B2

(12) United States Patent
Veres et al.

(10) Patent No.: US 11,691,435 B2
(45) Date of Patent: Jul. 4, 2023

(54) PRE-HEAT ADDRESSED VAPOR REJECTION FOR FOUNTAIN SOLUTION IMAGE FORMATION

(71) Applicant: Palo Alto Research Center Incorporated, Palo Alto, CA (US)

(72) Inventors: Janos Veres, San Jose, CA (US); David K. Biegelsen, Portola Valley, CA (US); Gregory B. Anderson, Emerald Hills, CA (US); Joerg Martini, San Francisco, CA (US); Joanne L. Lee, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/194,201

(22) Filed: Mar. 5, 2021

(65) Prior Publication Data

US 2022/0281228 A1 Sep. 8, 2022

(51) Int. Cl.

| | |
|---|---|
| ***B41J 2/005*** | (2006.01) |
| ***B41J 2/335*** | (2006.01) |
| *B41J 2/32* | (2006.01) |

(52) U.S. Cl.
CPC ..... *B41J 2/33505* (2013.01); *B41J 2/0057* (2013.01); *B41J 2/32* (2013.01)

(58) Field of Classification Search
CPC ..... B41J 2/33505; B41J 2/0057; B41J 2/32
See application file for complete search history.

(56) References Cited

U.S. PATENT DOCUMENTS

| | | | | |
|---|---|---|---|---|
| 4,278,467 | A | 7/1981 | Fadner | |
| 8,264,704 | B2 | 9/2012 | Jackson et al. | |
| 9,227,389 | B1 | 1/2016 | Zirilli | |
| 9,388,319 | B2 | 7/2016 | Mayo et al. | |
| 10,195,871 | B1 * | 2/2019 | Moore | B41F 7/24 |
| 2005/0084287 | A1 * | 4/2005 | Niimi | G03G 15/0266 399/176 |
| 2013/0032050 | A1 * | 2/2013 | Pattekar | G03G 15/228 101/148 |
| 2013/0327237 | A1 | 12/2013 | Jia et al. | |
| 2015/0375497 | A1 | 12/2015 | Stowe et al. | |

(Continued)

FOREIGN PATENT DOCUMENTS

EP 3284790 A2 2/2018

OTHER PUBLICATIONS

Fuyong Yue, Chunmei Zhang, Xiao-Fei Zang, Dandan Wen, Brian D Gerardot, Shuang Zhang and Xianzhong Chen, "High-resolution grayscale image hidden in a laser beam", Light: Science & Applications (2018) 7, 17129; doi:10.1038/lsa.2017.129, Official journal of the CIOMP 2047-7538/18.

(Continued)

*Primary Examiner* — Yaovi M Ameh
(74) *Attorney, Agent, or Firm* — Ortiz & Lopez, PLLC; Luis M. Ortiz; Kermit D. Lopez

(57) ABSTRACT

A method and system for enabling a patterned liquid, can involve creating a heat image on an imaging blanket by selectively heating the imaging blanket with a digitally controlled energy source, and subjecting the heat image to a selective deposition of a fountain solution material to enable vapor condensation on unheated areas and vapor rejection from heated areas to generate a fountain material image.

17 Claims, 5 Drawing Sheets

(56) References Cited

U.S. PATENT DOCUMENTS

| | | | | |
|---|---|---|---|---|
| 2018/0051183 | A1 | 2/2018 | Allen et al. | |
| 2019/0270897 | A1 * | 9/2019 | Allen | C09D 11/101 |

OTHER PUBLICATIONS

B. Michel et al., "Printing meets lithography: Soft approaches to high-resolution patterning", IBM J. Res. & DEV. vol. 45 No. 5 Sep. 2001.

Sameer S. Deshpande, "Fountain Solution in Lithographic Offset Printing", JERS, vol. II, Issue II, Apr.-Jun. 2011, pp. 82-88.

* cited by examiner

PRE-HEAT ADDRESSED VAPOR REJECTION FOR FOUNTAIN SOLUTION IMAGE FORMATION

TECHNICAL FIELD

Embodiments relate to digital printing systems and in particular, to digital architecture for lithographic inks (DALI) printing systems. Embodiments further relate to techniques for fountain solution image formation in DALI printing systems. Embodiments also relate to systems and methods for enabling a patterned liquid.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, examples of which include digital offset printing a Digital Architecture for Lithographic Inks (DALI) printing. A "variable data lithography system" is a system that can be configured for lithographic printing using lithographic inks and based on digital image data, which may be variable from one image to the next. "Variable data lithography printing," or "digital ink-based printing," or "digital offset printing," or DALI involves lithographic printing of variable image data for producing images on a media substrate that may be changeable with each subsequent rendering of an image on the media substrate in an image forming process.

One example of a conventional DALI system is disclosed U.S. Patent Application Publication No. 20190270897 entitled "Digital Offset Lithography Ink Composition," which published on Sep. 5, 2019 and is incorporated herein by reference in its entirety. U.S. Patent Application Publication No. 20190270897 is assigned to the Xerox Corporation and illustrates an example of an ink-based variable image digital printing system.

FIG. 1 illustrates a schematic diagram of a prior art digital printing system 100 that includes an imaging member 110. The digital printing system 100 can be implemented as a system for variable lithography. The imaging member 110 in the example depicted in FIG. 1 may be a drum, a drum, a plate or a belt, or another now known or later developed configuration.

The imaging member 110 can be used to apply an ink image to an image receiving media substrate 114 at a transfer nip 112. The transfer nip 112 can be formed by an impression roller 118, as part of an image transfer mechanism 160, exerting pressure in the direction of the imaging member 110. The image receiving media substrate 114 should not be considered to be limited to any particular composition such as, for example, paper, plastic, or composite sheet film. The digital printing system 100 may be used for producing images on a wide variety of image receiving media substrates.

The imaging member 110 may include a reimageable surface layer formed over a structural mounting layer that may be, for example, a cylindrical core, or one or more structural layers over a cylindrical core.

The digital printing system 100 can include a fountain solution system 120 that involves a series of rollers, which may be considered as dampening rollers or a dampening unit, for uniformly wetting the reimageable surface of the imaging member 110 with dampening fluid. A purpose of the fountain solution system 120 is to deliver a layer of dampening fluid, generally having a uniform and controlled thickness, to the reimageable surface of the imaging member 110.

As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the fountain solution system 120.

After a precise and uniform amount of dampening fluid is provided by the fountain solution system 120 on the reimageable surface of the imaging member 110, an optical patterning subsystem 130 may be used to selectively form a latent image in the uniform dampening fluid layer by imagewise patterning the dampening fluid layer using, for example, laser energy. Typically, the dampening fluid may not absorb the optical energy (IR or visible) efficiently. The optical patterning subsystem 130 can be implemented as or may include a light source 131 (e.g., a vertical cavity surface emitting (VCSEL) array, a light emitting diode (LED) array, a laser light source that emits the pixilated light beam as a pixelated line laser beam, or a modulated laser line source).

The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being or including a light source such as a laser emitter, it should be understood that a variety of different systems may be used to deliver the optical energy to pattern the dampening fluid.

The mechanics at work in the patterning process undertaken by the optical patterning subsystem 130 are known to those in the art. Briefly, the application of optical patterning energy from the optical patterning subsystem 130 can result in selective removal of portions of the layer of dampening fluid.

Following patterning of the dampening fluid layer by the optical patterning subsystem 130, the patterned layer over the reimageable surface of the imaging member 110 can be presented to an inker subsystem 140. The inker subsystem 140 can be used to apply a uniform layer of ink over the layer of dampening fluid and the reimageable surface layer of the imaging member 110. The inker unit 140 can further include heated ink baths whose temperatures can be regulated by a temperature control module (not shown in FIG. 1). The inker subsystem 140 may use, for example, an anilox roller to meter an offset lithographic ink onto one or more ink forming rollers that may be in contact with the reimageable surface layer of the imaging member 110. Separately, the inker subsystem 140 can include other traditional elements such as a series of metering rollers to provide a precise feed rate of ink to the reimageable surface. The inker subsystem 140 can deposit the ink to the pockets representing the imaged portions of the reimageable surface, while ink on the unformatted portions of the dampening fluid may not adhere to those portions.

The cohesiveness and viscosity of the ink residing in the reimageable layer of the imaging member 110 may be modified by a number of mechanisms. One such mechanism, for example, may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink can be then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller (not shown in FIG. 1) may first receive the ink image pattern and then transfer the ink image pattern to a substrate according to a known indirect transfer method. Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The cleaning subsystem 170 may comprise at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, and a doctor blade.

Other mechanisms by which cleaning of the reimageable surface of the imaging member 110 may be facilitated. Regardless of the cleaning mechanism, cleaning of the residual ink and dampening fluid from the reimageable surface of the imaging member 110 may be essential for preventing so-called 'ghosting'. Once cleaned, the reimageable surface of the imaging member 110 can be again presented to the fountain solution system 120 by which a fresh layer of dampening fluid can be supplied to the reimageable surface of the imaging member 110, and the process can be repeated.

In the prior art digital printing system 100 shown in FIG. 1, a blanket 113 (i.e., an 'imaging cylinder blanket' or 'imaging blanket') is shown. A printing plate 110 surrounds the cylindrically shaped blanket 113. The blanket 113 with the printing plate 110 shown in the FIG. 1 example can rotate in the direction indicated by curved arrow 115.

The ink must be compatible with materials that it comes into contact with, including the printing plate 110, fountain solution applied by fountain solution system 120, and other cured or non-cured inks. The ink should also meet all functional requirements of the sub-systems, including wetting and transfer properties. Transfer of the imaged inks is challenging, as the ink must at once wet the blanket material homogeneously (e.g. printing plate 110), and transfer from the blanket to the substrate (112, 114, and 118). Transfer of the image layer must be very efficient, at least as high as 90%, as the cleaning sub-station can only eliminate small amounts of residual ink. Any ink remaining on the blanket after cleaning would result in an unacceptable ghost image appearing in subsequent prints. Not surprisingly, ink rheology plays a key role in the transfer characteristics of an ink.

DALI print systems involve the use of DALI print process high power lasers and the ability to modulate them in a pixel-by-pixel fashion to produce latent fountain solution images that can be used to ink a printing blanket. A DALI system can enable the digital printing of high viscosity inks with high resolution. Such a high quality printing process can combine the inherent advantages of high pigment loading, low solvent content, inexpensive inks with the capability of printing with these inks in a digital fully customizable manner for each pixel in each print.

In the DALI printing process a continuous thin layer (e.g., tens of nanometers) of fountain solution, which can be deposited on the surface of the printing blanket, can reject the transfer of ink to the blanket. A high-power laser can be used to heat the surface region of the optically absorbing blanket and thereby evaporate the fountain solution in an image-wise pattern. The laser must, however, heat the blanket sufficiently to supply the latent heat of evaporation as well as the sensible heat to raise the fluid to its evaporation temperature (e.g., ~175 C). The evaporated areas can be then inked, and the ink can be transferred to a receiving medium.

Although DALI printing systems can enable the digital printing of high viscosity inks with a high resolution, the current DALI printing process can be relatively expensive due to the cost of high-power lasers and their modulation devices. Solutions are thus needed to reduce costs significantly for DALI printing systems.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved digital printing apparatus, system, and method of use.

It is another aspect of the disclosed embodiments to provide for improved DALI printing systems.

It is also an aspect of the disclosed embodiments to provide for improved methods and systems for fountain solution image formation in DALI printing systems.

It is a further aspect of the disclosed embodiments to provide for a vapor deposition system that may be utilized with a DALI printing system.

It is yet another aspect of the disclosed embodiments to provide for pre-heat addressed vapor rejection for fountain image solution in a DALI printing system using a vapor deposition technique.

The aforementioned aspects and other objectives and advantages can now be achieved as described herein. In an embodiment, a method for enabling a patterned liquid, can involve creating a heat image on an imaging blanket by selectively heating the imaging blanket with a digitally controlled energy source, and subjecting the heat image to a selective deposition of a fountain solution material to enable vapor condensation on unheated areas and vapor rejection from heated areas to generate a fountain material image.

An embodiment of the method can further involve developing the fountain material image on the imaging blanket with an ink.

An embodiment of the method can further involve transferring an ink to an image receiving media substrate.

An embodiment of the method can further involve: developing the fountain material image on the imaging blanket with an ink, and transferring the ink to an image receiving media substrate.

In an embodiment of the method, the imaging blanket can comprise an optically absorbing blanket.

An embodiment of the method can further involve creating the heat image on the imaging blanket by selectively heating the imaging blanket with the digitally controlled energy source through laser patterning.

In an embodiment of the method, the digitally controlled energy source can comprise one or more of: a laser source, a thermal print head, a flashlight, a light projection, an electron beam, and an array of heated pins.

In an embodiment, a system for enabling a patterned liquid can include: an imaging blanket, and a digitally controlled energy source, wherein a heat image is created on the imaging blanket by selectively heating the imaging blanket with the digitally controlled energy source, and wherein the heat image is subject to selective deposition of a fountain solution material to enable vapor condensation on unheated areas and vapor rejection from heated areas to generate a fountain material image.

In an embodiment of the system, the fountain material image can be developed on the imaging blanket with an ink.

In an embodiment of the system, an ink can be transferred to an image receiving media substrate.

In an embodiment of the system, the fountain material image can be developed on the imaging blanket with an ink, and the ink can be transferred to an image receiving media substrate.

In an embodiment of the system, imaging blanket can comprise an optically absorbing blanket.

In an embodiment of the system, the heat image can be created on the imaging blanket by laser patterning with the digitally controlled energy source.

In an embodiment of the system, the digitally controlled energy source can comprise one or more of: a laser source, a thermal print head, a flashlight, a light projection, an electron beam, and an array of heated pins.

In an embodiment, a system for enabling a patterned liquid, can include at least one processor and a memory, the memory storing instructions to cause the at least one processor to perform: creating a heat image on an imaging blanket by selectively heating the imaging blanket with a digitally controlled energy source, and subjecting the heat image to a selective deposition of a fountain solution material to enable vapor condensation on unheated areas and vapor rejection from heated areas to generate a fountain material image.

In an embodiment of the system, the instructions can be further configured to cause the at least one processor to perform: developing the fountain material image on the imaging blanket with an ink.

In an embodiment of the system, the instructions can be further configured to cause the at least one processor to perform: transferring an ink to an image receiving media substrate.

In an embodiment of the system, the instructions can be further configured to cause the at least one processor to perform: creating the heat image on the imaging blanket by selectively heating the imaging blanket with the digitally controlled energy source through laser patterning.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the embodiments.

DETAILED DESCRIPTION

Figure 1:
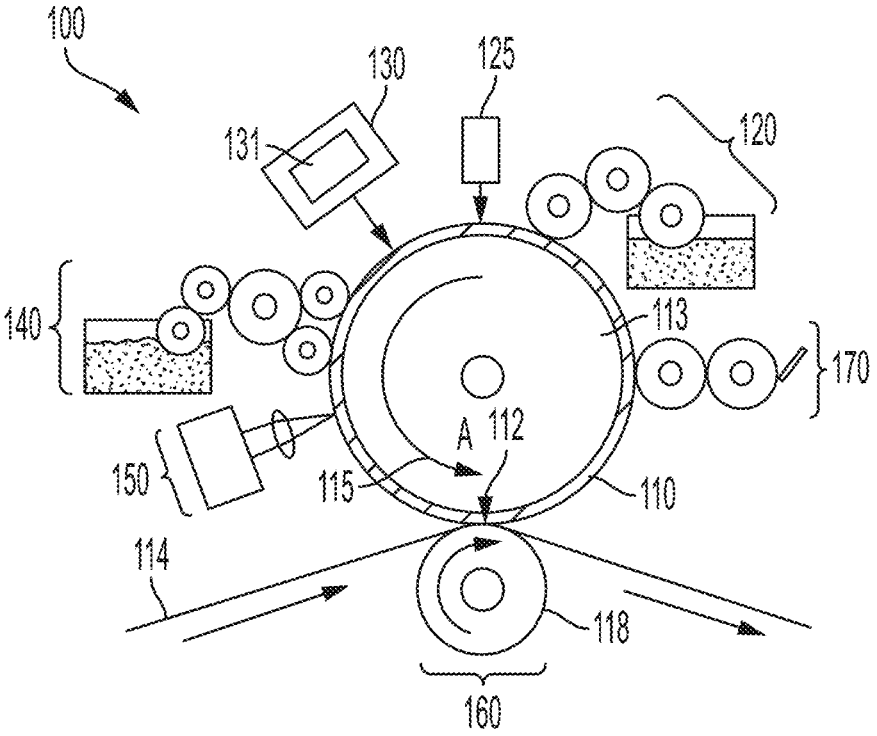
FIG. 1 PRIOR ART
FIG. 1 illustrates a schematic diagram of a prior art digital printing system.

The particular values and configurations discussed in these non-limiting examples can be varied and are cited merely to illustrate one or more embodiments and are not intended to limit the scope thereof. Exemplary embodiments are intended to cover all alternatives, modifications, and equivalents as may be included within the spirit and scope of the composition, apparatus and systems as described herein.

A more complete understanding of the processes, systems and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawing, like reference numerals may be used throughout to designate similar or identical elements.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein do not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The term 'fountain solution' as utilized herein generally refers to a material, which can adhere to a substrate and may split in an inking nip to reject ink from adhering to the substrate. In some situations the fountain solution can adhere to a substrate and bind ink, which does not otherwise adhere to the substrate. Below we will speak of the former use, however it should be read as applying in either modality. The fluid (i.e., liquid, solution, etc) referred to herein can be a water or aqueous-based fountain solution which can be applied in an airborne state such as by vapor or by direct contact with a wetted imaging member through a series of rollers for uniformly wetting a member with the fluid. The solution or fluid can be non-aqueous composed of, for example, silicone fluids (e.g., such as D3, D4, D5, OS10, OS20, OS30 and the like), Isopar fluids, and polyfluorinated ether or fluorinated silicone fluid.

Note that the term 'fountain solution' as utilized herein is not limited to the aforementioned splitting feature. That is, a 'fountain solution' can include, for example, a thin fountain solution that does not split, but which can adhere to the ink and may be removed from the substrate in its entirety. Thus, a fountain solution may include situations involving a non-splitting, complete removal of the fountain solution by ink. Furthermore, the fountain solution may only partially or may not at all adhere to the ink, thereby still rejecting the transfer of ink to the substrate. In this case, removal of the fountain solution after the inking nip may be required.

The modifier "about" used in connection with a quantity may be inclusive of the stated value and can have a meaning dictated by the context (for example, it may include at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather can be used to distinguish one element from another. The terms "a" and "an" herein may not denote a limitation of quantity, but rather can denote the presence of at least one of the referenced item.

The term "printing device", "printing system", or "digital printing system" as used herein can refer to a digital copier or printer, scanner, image printing machine, digital production press, document processing system, image reproduction machine, bookmaking machine, facsimile machine, multifunction machine, or the like and can include several marking engines, feed mechanism, scanning assembly as well as other print media processing units, such as paper feeders, finishers, and the like. The digital printing system can handle sheets, webs, marking materials, and the like. A digital printing system can place marks on any surface, and the like and is any machine that can read marks on input sheets; or any combination of such machines.

The term "printing device", "printing system", or "digital printing system" and variations thereof as used herein may refer to devices and systems based on ink printing or which can provide imaged liquid layers for applications other than ink printing, such as, for example, three-dimensional (3D) layer-by-layer construction using ultraviolet (UV) curable liquids.

The acronym 'DALI' refers to the term 'Digital Architecture for Lithographic Inks'. DALI has in some instances also been referred to as 'Digital Advanced Lithographic Imaging'. Thus, the terms 'Digital Advanced Lithographic Imaging' and 'Digital Architecture for Lithographic Inks' can be utilized interchangeably to refer to the same type of DALI printing system, DALI printing device or DALI printing method.

FIG. 1 discussed previously depicts a continuous, uniform layer of fountain solutions deposited by roll-roll transfer (shown), vapor condensation, or other means (not shown), followed by selective evaporative removal.

Figure 2:
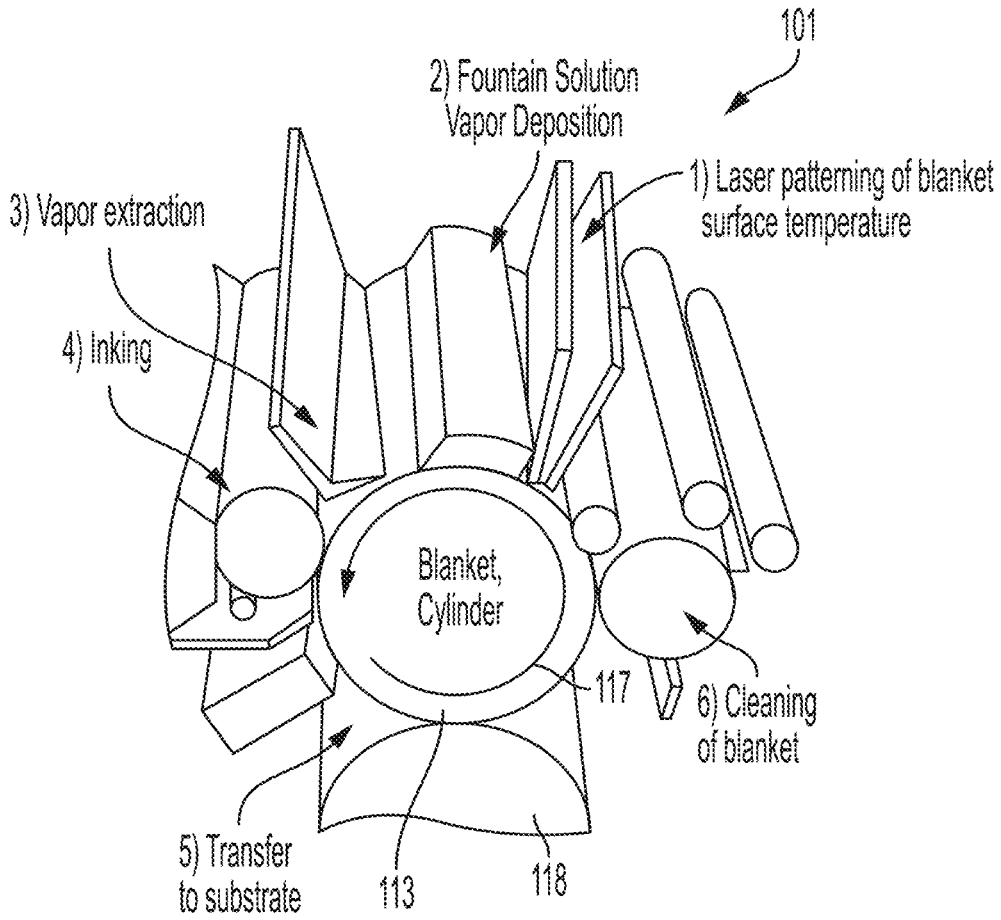
FIG. 2 illustrates a perspective view of a digital printing system, which can be implemented in accordance with an embodiment.

FIG. 2 illustrates a perspective view of an exemplary digital printing system 101, in accordance with an embodiment. The digital printing system 101 shown may include the use of some of the same elements from the prior art system 100 depicted in FIG. 1. Despite the use of such similar elements or components, it should be appreciated that the digital printing system 101 shown in FIG. 2 is different from and represents an improvement over the prior art digital printing system 100 depicted in FIG. 1.

The digital printing system 101 may be implemented as a DALI printer/DALI printing system. In the embodiment shown in FIG. 2, the blanket 113 can be configured to rotate in the direction indicate by arrow 117. The blanket 113 is shown in FIG. 2 above and with respect to the impression roller 118. Note that the term 'blanket' as utilized herein may also refer to an imaging blanket, a printing blanket, an ink blanket or an inking blanket. In some embodiments, the blanket 113 shown in FIG. 2 may be an optically absorbing blanket.

DALI printing systems can involve the use of DALI print process high power lasers and the ability to modulate them in a pixel-by-pixel fashion to produce latent fountain solution images that can be used to ink the printing blanket. As shown in FIG. 2, the digital printing system 101 can enable the digital printing of high viscosity inks with high resolution (e.g., up to 1200 dpi). Such a high quality printing process can combine the inherent advantages of high pigment loading, low solvent content, inexpensive inks with the capability of printing with these inks in a digital format—meaning fully customizable for each pixel in each print fashion. Note that the terms 'image", "images" and 'imaging' as utilized herein can relate to a two-dimensional distribution of adjacent pixel with differing properties (e.g., temperature).

In the DALI printing process, a continuous thin layer (tens of nanometers) of fountain solution, which can be deposited on the surface of the printing blanket, may reject the transfer of ink to the blanket. A high-power laser can be used to heat the surface region of the optically absorbing blanket and thereby evaporate the fountain solution in an image-wise pattern. The laser must, however, heat the blanket sufficiently to supply the latent heat of evaporation as well as the sensible heat to raise the fluid to its evaporation temperature (e.g., ~175 C). The evaporated areas can be then inked, and the ink can be transferred to a receiving medium.

A number of steps or operations are shown in FIG. 2 that illustrate an embodiment of a DALI printing process. In Step 1, an operation involving laser patterning by selective rejection of fountain solution vapor can be implemented. For example, Step 1 can involve digital patterning of the blanket surface temperature with near infrared (NIR) laser light, and the blanket heated by the laser, such that D4 evaporates from the hot blanket but remains on cold blanket followed by a negative D4 image on the blanket.

In Step 2, a fountain solution vapor deposition can be implemented. For example, the Step 2 operation can involve deposition of a fountain solution (e.g., D4, fluorosilicone oil) from a vapor phase onto an optically absorbing blanket 12 (e.g., 50 . . . 100 nm D4 condensed onto blanket).

In Step 3, vapor extraction may be implemented. For example, D4 vapor can be extracted by vacuum to prevent re-condensation. In Step 4, an inking operation may be implemented. That is, high viscosity ink can be transferred to the blanket, but rejected by D4 on the blanket followed by the rendering of a positive ink image on the blanket. In Step 5, an operation can be implemented involving ink transfer to a substrate (paper, etc.). In Step 6, an operation involve cleaning (and oiling) of the blanket can be implemented.

Although DALI printing systems can enable the digital printing of high viscosity inks with a high resolution, the DALI printing process can be relatively expensive to implement and run due to the cost of high-power lasers and their modulation devices. Solutions are thus needed to reduce costs significantly for DALI printing systems. The embodiment shown in FIG. 2 offers a solution by enabling a patterned liquid through first (Step 1), creating a heat image on an imaging blanket by selectively heating the imaging blanket with a digitally controlled energy source, and then second (Step 2), subjecting the heat image to a selective deposition of a fountain solution material on unheated areas to generate a fountain material image. The temperatures (heat) required to reject vapor condensation may be far lower than those that may be required to enable liquid evaporation. Therefore, lower power and less costly heat patterning systems can be implemented with one or more embodiments. Step 2 can involve subjecting a heat image to a selective deposition of a fountain solution material to enable vapor condensation on unheated areas and vapor rejection from heated areas to generate a fountain material image.

An example of a digitally controlled energy source, which can be used with the embodiment shown in FIG. 2 and the aforementioned Step 1 and Step 2 operations, is the light source 131 shown in FIG. 1. Furthermore, the optical patterning subsystem 130 shown in FIG. 1 can also be implemented with the digital printing system 101 shown in FIG. 2, and can include the light source 131 (e.g., a vertical cavity surface emitting (VCSEL) array, a light emitting diode (LED) array, a laser light source that emits the pixilated light beam as a pixelated line laser beam, a modulated laser line source, a resistive heater array, a modulated electron beam, etc.).

The embodiments disclosed herein involve a method (e.g., method 400 shown in FIG. 5) that can use much lower power as compared to conventional DALI systems such as the prior art digital printing system 100 depicted in FIG. 1, by preheating, image-wise, the blanket surface before the application of the fountain solution vapor. The surface can move through the vapor deposition system immediately after the image-wise heating of the blanket surface and only the non-pre-heated areas will nucleate the layer of fountain solution. The small rise in temperature in the preheated areas desorbs the incident vapor, preventing the nucleation of the fountain solution liquid phase, and leaves the blanket dry so that it can bind ink.

The amount of energy needed to prevent fluid accumulation may be much less than the amount of energy that may be needed to evaporate the fountain solution, because the temperature of the underlying blanket may not need to reach the evaporation temperature of the fountain solution, but may only need to attain a temperature above the condensation point of the fountain solution for the given pressure, typically around 1 atm. Furthermore, recondensation of digitally evaporated fountain solution will pose much less of an issue. The pre-heating process can be accomplished on current DALI printers by moving the imager upstream of a vapor deposition system or a vapor deposition process.

Another embodiment of the pre-heat method of forming an image can involve allowing for or permitting the functions of the image formation surface/roll and the inking surface/roll to be separated by the addition of an intermediate roll/surface to the system. This separation can allow the surfaces to be separately optimized to perform a single function. The image formation roll/surface can be optimized for energy absorption while the blanket roll/surface can be optimized for ink pick up and release.

A wide latitude of marking (printing) materials may be used with the digital printing system 101, including marking materials with pigment loading greater than 10% by weight. Note that disclosure uses the term 'ink' to refer to a broad range of printing or marking materials to include those, which are commonly understood to be inks, pigments, and other materials, which may be applied by a printing system to produce an output image on a image receiving media substrate.

Figure 3:
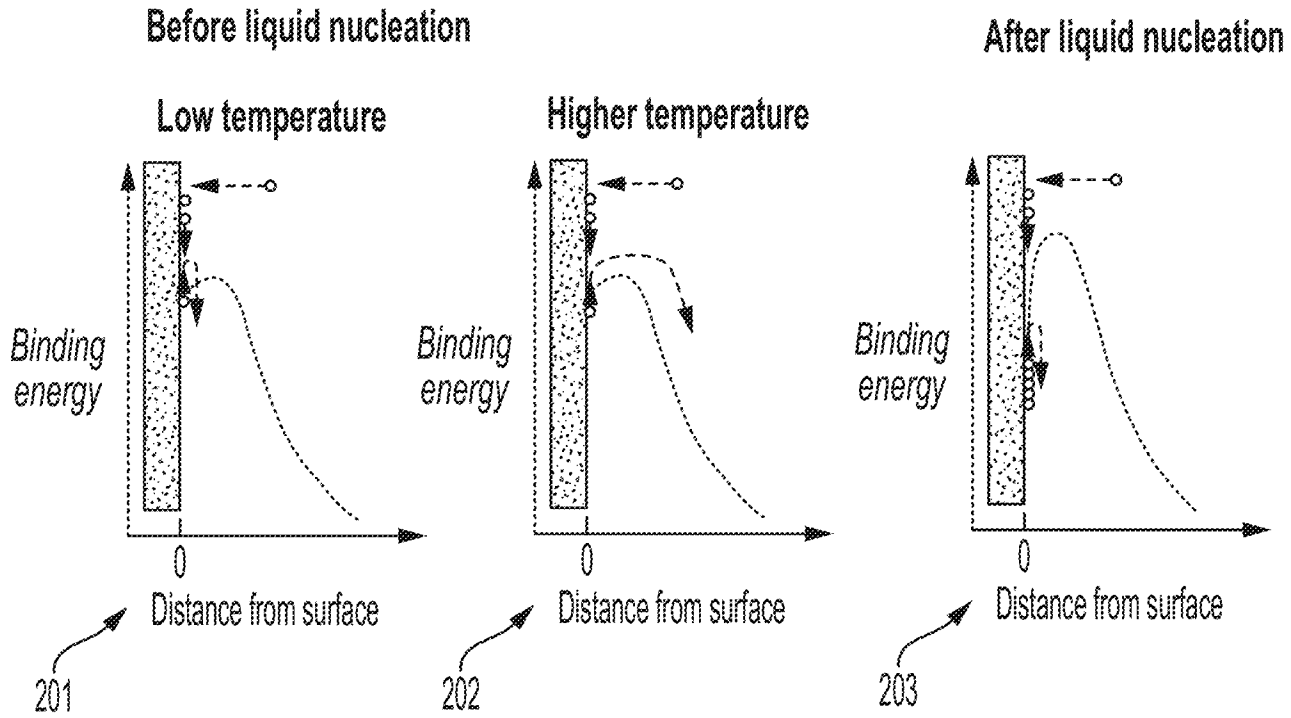
FIG. 3 illustrates graphs, which represent parts of a fountain solution deposition process, which can be implemented in accordance with an embodiment.

FIG. 3 illustrates graphs 201, 202, and 203, which can demonstrate the DALI printing process, in accordance with an embodiment. As discussed previously herein, the DALI printing process may be relatively expensive to implement due to the cost of high-power lasers and their associated modulation devices. A method to reduce costs significantly can involve the formation of a fountain solution image in a manner, which does not require supplying the latent heat of evaporation to a continuous liquid layer. This can reduce the power requirements and the cost of the imager.

In accordance with the disclosed embodiments, a method of fountain solution image generation can be implemented either on the DALI blanket directly or on an intermediate roller or other surface and subsequent transfer to a DALI blanket. Specifically, the disclosed approach entails heating a surface (e.g., on a roller with an optically absorbing surface) with relatively low power, image-wise laser illumination or other heating means, to control vapor deposition. Above a certain surface temperature physisorbed vapor evaporates rapidly leaving an uncoated surface whereas at a slightly lower surface temperature vapor resides long enough to nucleate a liquid film.

Importantly, the surface temperature at which vapor rejection takes place is far lower than that needed to evaporate a liquid film. Also, the temperature difference between that required to reject vapor deposition and allow for vapor deposition, is relatively small. The liquid image thus generated can be either used directly or subsequently transferred (split) in a nip formed between the intermediate roller surface and the DALI blanket. DALI inking and transfer to an image receiver medium can be then performed as in the current DALI process. The use of an intermediate roller can allow for separate optimization of the properties of the vapor rejecting surface and the DALI blanket.

FIG. 3 explains steps involved in the disclosed DALI printing process. A molecule in the vapor approaches the surface and is physisorbed. The molecule is bound to the surface in a potential minimum as indicated by the red binding energy curve. The molecule diffuses on the surface as part of a two-dimensional gas of physisorbed molecules. Depending on the surface temperature the molecule frequently attempts to bounce off the surface. If its thermal energy is sufficient to overcome the binding energy peak as shown in graph 201, the molecule can depart and may not return. Conversely, if the surface temperature is lower as shown in graph 201, the probability that the energy of the molecule may allow it to overcome the binding energy peak can be greatly reduced and the density of such molecules can increase. In graph 203, we see that if molecules stay on the surface long enough to find other molecules and overcome a nucleation barrier (i.e., basically, the latent heat of condensation) then the binding energy of such molecules can be greatly increased.

Thus, at low surface temperatures, molecules may "stick" and a surface liquid or solid can develop. At slightly higher temperatures molecules can leave the surface before nucleation can occur and the surface can be left basically denuded of molecules. Therefore, by image-wise heating a cool surface image-wise region of liquid coverage and no coverage can be created. This can be referred to as "Preheat Addressed Vapor Rejection" or "PHAVoR".

Depending on the surface free energies of the solid substrate and the liquid, the temperature range between sticking and rejection can be as small as, for example, ~5-10 C and the transition range can lie more than 100 C below the surface temperature required to rapidly evaporate a surface liquid. Ideally the arrival rate of molecules may be just higher than necessary to entirely cover the surface in its low temperature condition with the desired thickness of condensed liquid or solid in the dwell time under the incident flux.

An embodiment can involve the use of vapor deposition. That is, an optically absorbing, low surface energy material can be image-wise heated by a pixelated light beam (e.g., a raster scanned, intensity modulated laser, a pixelated line laser beam, a VCSEL or LED array, etc.) projected onto a surface. Alternatively, a thermal print head may be used to create the surface thermal excursions.

It may be desirable to have the process direction length between heating and complete development be as short as possible so that the surface does not cool below the vapor rejection range due to conduction into the bulk while still in the presence of fountain solution vapor. It may also be desirable to place the vapor deposition system as close as feasible (1) to the transfer nip (e.g., such as transfer nip 112 shown in FIG. 1, which can also be implemented in the context of the embodiment depicted in FIG. 2) between the fountain imaging roll and an inking blanket (e.g., such as the blanket 113 shown in FIG. 2), in the case of a pre-roller system, or (2) to the inking nip, in the case of direct fountain formation on the inking blanket. The downstream vapor exhaust channel can be an important feature in preventing vapor from escaping a vapor deposition zone and potentially poisoning the inker itself. Vapor deposition may need to be held near the deposition surface to minimize vapor escape and boundary layer effects.

Figure 4:
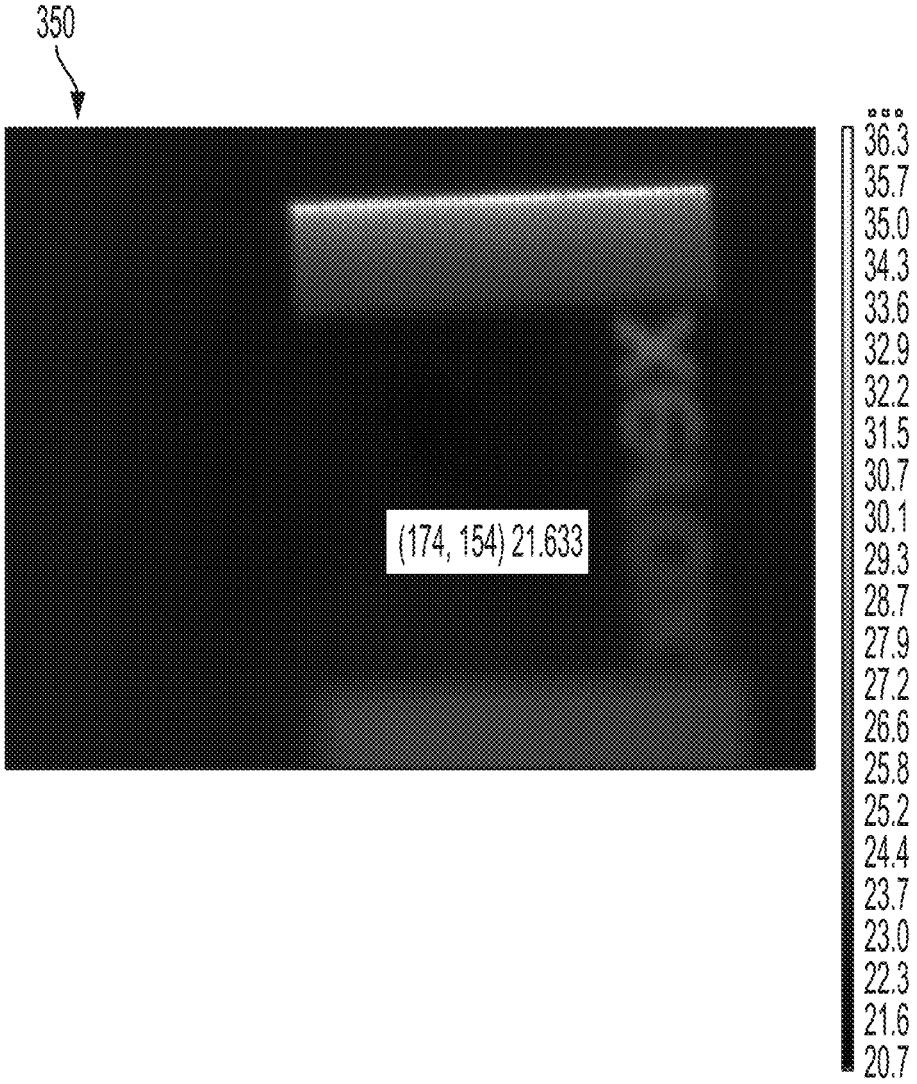
FIG. 4 illustrates an image demonstrating experimental results for laser-induced heat images and vapor deposition imaging control and transfer to the inking blanket as evidenced by the final ink images transferred to paper, in accordance with an embodiment.

FIG. 4 illustrates an image 350 demonstrating experimental results for laser-induced heat images and vapor deposition imaging control and transfer to the inking blanket as evidenced by the final ink images transferred to paper, in accordance with an embodiment.

The image 350 depicted in FIG. 4 is a pyrometric camera image of the DALI blanket surface. A modulated laser line source (A) can be utilized to heat the rotating blanket image-wise to form a thermal image on the blanket. The blanket can move from top to bottom. The time difference here from the laser line source to the bottom of the image may be, for example, ~100 milliseconds. The chart on the right side of image 350 indicates that the temperature of the blanket is still ~10 degrees Celsius higher than the non-imaged areas. This temperature difference is enough to prevent nucleation of the fountain solution.

Figure 5:
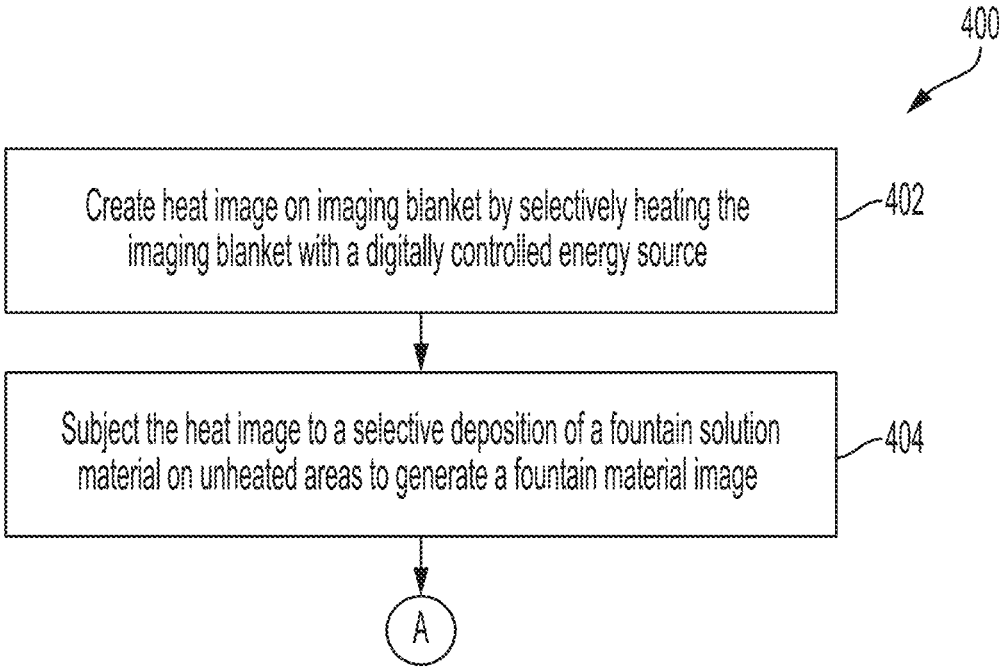
FIG. 5 illustrates a flow chart of operations depicting logical operational steps of a method for digital advanced lithographic imaging, in accordance with an embodiment.

FIG. 5 illustrates a flow chart of operations depicting logical operational steps of a method 400 for digital advanced lithographic imaging, in accordance with an embodiment. The method 400 shown in FIG. 5 can be implemented for enabling a patterned liquid in a digital advanced lithographic imaging process such as provided by the digital printing system 101 shown in FIG. 2. As shown at block 402, a step, operation or instructions can be implemented to create a heat image on an imaging blanket by selectively heating the imaging blanket (e.g., such as the blanket 113 shown in FIG. 2) with a digitally controlled energy source (e.g., such as the previously discussed light source 131). Examples of the digitally controlled energy source include devices or components such as a laser source, a thermal print head, a flashlight, a light projection, an electron beam, an array of heated pins, etc.

Following implementation of the operation depicted at block 402, a step, operation, or instructions can be implemented as depicted at block 404 to subject the heat image to a selective deposition of a fountain solution material on unheated areas to generate a fountain material image. The step or operation shown at block 404 thus involves subjecting the heat image to a selective deposition of a fountain solution material to enable vapor condensation on unheated areas and vapor rejection from heated areas to generate a fountain material image.

The steps, operations or instructions of method 400 shown in FIG. 5 can be implemented with respect to the digital printing system 101 shown in FIG. 2 and can involve the use of vapor deposition and excess vapor removal as discussed previously. Note that as utilized herein, the terms 'steps', 'instructions' and 'operations' can be utilized interchangeably to refer to the same activity or feature.

Figure 6:
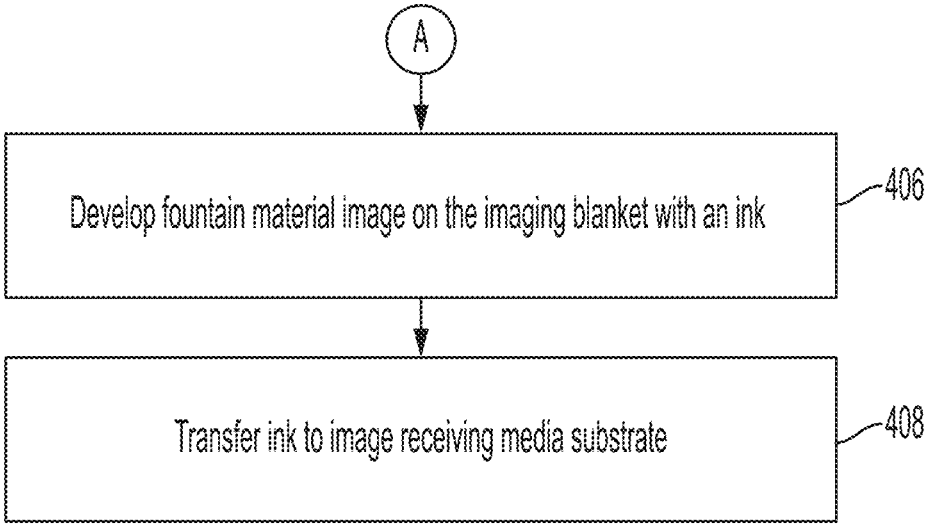
FIG. 6 illustrates additional logical operational steps, which may be implemented in accordance with the embodiment shown in FIG. 5.

FIG. 6 illustrates additional logical operational steps, which may be implemented with the method 400 shown in FIG. 5, in accordance with an embodiment. For example, as shown at block 406, a step, operation or instructions can be implemented to develop the fountain material image on the imaging blanket with an ink, followed by a step, operation or instructions for transferring the ink to an image receiving media substrate, as depicted at block 408.

The heat image may be created on the imaging blanket by laser patterning with the digitally controlled energy source. Note that in some embodiments, this laser patterning may involve digital patterning of the fountain digital patterning of the fountain solution with NIR laser light, with the blanket 113 shown in FIG. 2 heated by a laser, following by, for example, D4 evaporating from the hot blanket but remaining on the cold blanket, resulting in a negative D4 image on the blanket. In some embodiments, the vapor deposition operation described above with respect to block 404 depicted in FIG. 2 may involve deposition of the fountain solution (e.g., D4, fluorosilicone oil) from the vapor phase onto the blanket (e.g., 50 . . . 100 nm D4 frozen on blanket).

In some instances, vapor (e.g., a D4 vapor) can be extracted by vacuum to prevent re-condensation. A high viscosity ink, for example, can be then transferred to the blanket 113, but rejected by D4 on the blanket, followed by a positive ink image on the blanket. The ink can be then transferred to the media substrate (e.g., as shown at block 408). Additional operations may involve cleaning (and oiling) of the blanket 113 as discussed previously.

The techniques described herein can be applied to various types of digital printing systems such as DALI printing systems. In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions, steps, operations or sub-operations of distinct operations may be implemented in an intermittent and/or alternating manner. In a preferred embodiment, the step or operation shown at block 402 in FIG. 5 should be performed before the instruction(s) (step or operation) depicted at block 404 in FIG. 5.

It should also be noted that at least some of the operations for the methods described herein may be implemented using software instructions stored on a computer useable storage medium for execution by a computer. As an example, an embodiment of a computer program product includes a computer useable storage medium to store a computer readable program.

The computer-useable or computer-readable storage medium can be an electronic, magnetic, optical, electromagnetic, infrared, or semiconductor system (or apparatus or device). Examples of non-transitory computer-useable and computer-readable storage media include a semiconductor or solid-state memory, magnetic tape, a removable computer diskette, a random access memory (RAM), a read-only memory (ROM), a rigid magnetic disk, and an optical disk. Current examples of optical disks include a compact disk with read only memory (CD-ROM), a compact disk with read/write (CD-R/W), a digital video disk (DVD), Flash memory, and so on.

Alternatively, embodiments of the invention may be implemented entirely in hardware or in an implementation containing both hardware and software elements. In embodiments that do utilize software, the software may include but is not limited to firmware, resident software, microcode, etc.

In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Based on the foregoing, it can be appreciated that a number of preferred and alternative embodiments are discussed herein. For example, in one embodiment, a method for enabling a patterned liquid, can involve creating a heat image on an imaging blanket by selectively heating the imaging blanket with a digitally controlled energy source, and subjecting the heat image to a selective deposition of a fountain solution material on unheated areas to generate a fountain material image.

An embodiment of the method can further involve developing the fountain material image on the imaging blanket with an ink.

An embodiment of the method can further involve transferring an ink to an image receiving media substrate.

An embodiment of the method can further involve: developing the fountain material image on the imaging blanket with an ink, and transferring the ink to an image receiving media substrate.

In an embodiment of the method, the imaging blanket can comprise an optically absorbing blanket.

An embodiment of the method can further involve creating the heat image on the imaging blanket by selectively heating the imaging blanket with the digitally controlled energy source through laser patterning.

In an embodiment of the method, the digitally controlled energy source can comprise one or more of: a laser source, a thermal print head, a flashlight, a light projection, an electron beam, and an array of heated pins.

In another embodiment, a system for enabling a patterned liquid can include: an imaging blanket, and a digitally controlled energy source, wherein a heat image is created on the imaging blanket by selectively heating the imaging blanket with the digitally controlled energy source, and wherein the heat image is subject to a selective deposition of a fountain solution material on unheated areas to generate a fountain material image.

In an embodiment of the system, the fountain material image can be developed on the imaging blanket with an ink.

In an embodiment of the system, an ink can be transferred to an image receiving media substrate.

In an embodiment of the system, the fountain material image can be developed on the imaging blanket with an ink, and the ink can be transferred to an image receiving media substrate.

In an embodiment of the system, imaging blanket can comprise an optically absorbing blanket.

In an embodiment of the system, the heat image can be created on the imaging blanket by laser patterning with the digitally controlled energy source.

In an embodiment of the system, the digitally controlled energy source can comprise one or more of: a laser source, a thermal print head, a flashlight, a light projection, an electron beam, and an array of heated pins.

In yet another embodiment, a system for enabling a patterned liquid, can include at least one processor and a memory, the memory storing instructions to cause the at least one processor to perform: creating a heat image on an imaging blanket by selectively heating the imaging blanket with a digitally controlled energy source; and subjecting the heat image to a selective deposition of a fountain solution material on unheated areas to generate a fountain material image.

The aforementioned instructions can be further configured to cause the at least one processor to perform: developing the fountain material image on the imaging blanket with an ink. Furthermore, such instructions can be configured to cause the at least one processor to perform: transferring an ink to an image receiving media substrate. In addition, such instructions can be configured to cause the at least one processor to perform: creating the heat image on the imaging blanket by selectively heating the imaging blanket with the digitally controlled energy source through laser patterning.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A method for enabling a patterned liquid, comprising:

creating a heat image on an imaging blanket by selectively laser heating the imaging blanket with a digitally controlled energy source;

subjecting the heat image to a selective deposition of a fountain solution material from a vapor phase to enable vapor condensation on unheated areas and vapor rejection from heated areas to generate a fountain material image;

wherein the digitally controlled energy source comprises a light source that heats a surface region of the imaging blanket; and wherein the light source comprises at least one of: a vertical cavity surface emitting (VCSEL) array, a light emitting diode (LED) array, a laser light source that emits a pixilated light beam as a pixelated line laser beam, or a modulated laser line source.

2. The method of claim 1 further comprising developing the fountain material image on the imaging blanket with an ink.

3. The method of claim 1 further comprising:

extracting vapor by a vacuum to facilitate prevention of re-condensation;

transferring an ink to an image receiving media substrate.

4. The method of claim 1 further comprising:

developing the fountain material image on the imaging blanket with an ink; and transferring the ink to an image receiving media substrate.

5. The method of claim 1 wherein;

the imaging blanket comprises an optically absorbing blanket.

6. The method of claim 1 wherein the imaging blanket comprises a rotatable blanket.

7. A system for enabling a patterned liquid, comprising:

an imaging blanket; and a digitally controlled energy source, wherein a heat image is created on the imaging blanket by selectively laser heating the imaging blanket with the digitally controlled energy source, and wherein the heat image is subject to a selective deposition of a fountain solution material from a vapor phase to enable vapor condensation on unheated areas and vapor rejection from heated areas to generate a fountain material image;

wherein the digitally controlled energy source comprises a light source comprising at least one of: a vertical cavity surface emitting (VCSEL) array, a light emitting diode (LED) array, and a laser light source that emits a pixilated light beam as a pixelated line laser beam.

8. The system of claim 7 wherein the fountain material image is developed on the imaging blanket with an ink.

9. The system of claim 7 wherein:

vapor is extracted by a vacuum to facilitate prevention of re-condensation;

an ink is transferred to an image receiving media substrate.

10. The system of claim 7 wherein:

the fountain material image is developed on the imaging blanket with an ink; and the ink is transferred to an image receiving media substrate.

11. The system of claim 7 wherein the light source heats a surface region of the imaging blanket, and the imaging blanket comprises an optically absorbing blanket.

12. The system of claim 7 wherein the imaging blanket comprises a rotatable blanket.

13. A system for enabling a patterned liquid, comprising:

at least one processor and a memory, the memory storing instructions to cause the at least one processor to perform:

creating a heat image on an imaging blanket by selectively laser heating the imaging blanket with a digitally controlled energy source; and subjecting the heat image to a selective deposition of a fountain solution material from a vapor phase to enable vapor condensation on unheated areas and vapor rejection from heated areas to generate a fountain material image;

wherein the digitally controlled energy source comprises a light source comprising at least one of: a vertical cavity surface emitting (VCSEL) array, a light emitting diode (LED) array, and a modulated laser line source.

14. The system of claim 13 wherein the instructions are further configured to cause the at least one processor to perform:

developing the fountain material image on the imaging blanket with an ink.

15. The system of claim 13 wherein the instructions are further configured to cause the at least one processor to perform:

extracting vapor by a vacuum to facilitate prevention of re-condensation;

transferring an ink to an image receiving media substrate.

16. The system of claim 13 wherein the light source heats a surface region of the imaging blanket.

17. The system of claim 13 wherein the imaging blanket comprises a rotatable blanket.

* * * * *